US008342500B2

(12) United States Patent
Katayama

(10) Patent No.: US 8,342,500 B2
(45) Date of Patent: Jan. 1, 2013

(54) SHEET CONVEYING APPARATUS, IMAGE FORMING APPARATUS, AND IMAGE READING APPARATUS

(75) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/960,292

(22) Filed: Dec. 3, 2010

(65) Prior Publication Data

US 2011/0133399 A1 Jun. 9, 2011

(30) Foreign Application Priority Data

Dec. 8, 2009 (JP) ..... 2009-278964

(51) Int. Cl.
*B65H 5/22* (2006.01)
*B65H 5/34* (2006.01)

(52) U.S. Cl. .... 271/4.01; 271/270; 271/272; 271/10.01; 271/9.13

(58) Field of Classification Search ..... 271/4.01, 271/10.01, 272, 270, 264, 9.13
See application file for complete search history.

(56) References Cited

U.S. PATENT DOCUMENTS

| | | | |
|---|---|---|---|
| 6,161,829 | A | 12/2000 | Kusumi |
| 7,621,519 | B2 | 11/2009 | Sagawa |
| 7,681,874 | B2 | 3/2010 | Kusumi |
| 2005/0062222 | A1 | 3/2005 | Willis |
| 2008/0296837 | A1 | 12/2008 | Jowett et al. |
| 2011/0127709 | A1 | 6/2011 | Katayama |

FOREIGN PATENT DOCUMENTS

JP 2008-037587 A 2/2008

*Primary Examiner* — Luis A Gonzalez
(74) *Attorney, Agent, or Firm* — Canon USA, Inc., IP Division

(57) ABSTRACT

An elastic sponge roller is provided at a confluence portion where a first sheet conveyance path joins in a second sheet conveyance path and a leading edge and a rear edge of a sheet are brought into contact with the sponge roller when the sheet is conveyed from the first conveyance path to the second conveyance path. Further, the sponge roller is connected to drive via a one-way clutch. Such a configuration reduces a sound produced at the confluence portion and prevents the leading edge of the sheet from being bent in colliding with the sponge roller to stabilize the conveyance of the sheet.

21 Claims, 19 Drawing Sheets

SHEET CONVEYING APPARATUS, IMAGE FORMING APPARATUS, AND IMAGE READING APPARATUS

BACKGROUND OF THE INVENTION

1. Field of the Invention

The present invention relates to a sheet conveying apparatus for conveying a sheet such as recording paper or a document, and an image forming apparatus and an image reading apparatus which include the sheet conveying apparatus.

2. Description of the Related Art

In recent years, an operational noise of a copying machine has been reduced thanks to various noise reduction measures. This makes a sound audible in which we have been deafened by the operational noise of an image forming unit of the copying machine, more specifically, we recently notice a sound produced by a sheet hitting against a conveyance guide when conveyed. Such a sound is produced when a leading edge of a sheet S hits against a conveyance guide 400 at a confluence portion of one conveyance path and the other conveyance path, as illustrated in FIG. 17A. Alternatively, such a sound is produced by a rear edge of the sheet S touching the conveyance guide 400 when the rear edge of the sheet S is guided through a curved conveyance path, as illustrated in FIG. 17B, reaches the confluence portion, and the bending sheet is returned to an initial state by the elastic force of the sheet.

Since a sheet is subjected to a large stress because the conveyance paths intersect each other at that part, a large rubbing force is exerted between the sheet conveyance paths and the sheet. For this reason, the conveyance of paper high in stiffness such as thick paper is problematic.

To solve the above problem, a technique is discussed in which a belt serving as a unit for moving and guiding a sheet is provided on a second sheet conveyance unit to cause the leading and rear edges of the sheet to contact the belt in an apparatus having a confluence portion of a first conveyance path and a second conveyance path. The technique is discussed in Japanese Patent Application Laid-Open No. 2008-037587.

In a conventional apparatus using a conveyance belt at the confluence portion, however, the conveyance belt plays the role of not only easing collision but also conveying the sheet, so that it is desirable to use a material with a high friction and a high hardness (60° Hs, JIS A, for example). This is because the conveyance belt made of a low-hardness material may squash at a nip portion with a conveyance roller and cause damages such as deformation and a bend on the leading edge to the conveying sheet.

The hardness of the conveyance belt needs to be set low to effectively reduce a sound produced when the sheet collides the conveyance belt. When the sheet conveyed by an upstream roller pair at a conveyance speed V1 enters an intersecting path and collides the conveyance belt and a conveyance direction of the sheet is changed, the leading edge of the sheet is moved at a speed V2 faster than the conveyance speed V1 (V1<V2). When the leading edge of the sheet collides the conveyance belt and the conveyance direction of the sheet is changed to the direction along the belt surface of the conveyance belt, a sheet with a high stiffness (rigidity) is less liable to be bent. Conveying the sheet with the sheet less bent makes the moving speed V2 of the leading edge of the sheet faster than the conveyance speed V1. Particularly, the stiffer the sheet, the faster the moving speed of leading edge of the sheet when the conveyance direction is changed.

Because the conveyance speed of the conveyance belt is V1, the leading edge of the sheet which is faster in moving speed than V1 is caught on the conveyance belt, which may bend the leading edge of the sheet and cause jam.

SUMMARY OF THE INVENTION

The present invention is directed to a sheet conveying apparatus for reducing a sound produced at a confluence portion of two sheet conveyance paths different in conveyance direction from each other and stabilizing conveyance of the sheet, and an image forming apparatus and an image reading apparatus which include the sheet conveying apparatus.

According to an aspect of the present invention, a sheet conveying apparatus includes a confluence portion formed by a first sheet conveyance path joining in a second sheet conveyance path, a first sheet conveyance unit which is provided at an upstream side of the confluence portion and configured to convey a sheet in the first sheet conveyance path, and a second sheet conveyance unit which is provided at a downstream side of the confluence portion and configured to convey a sheet conveyed from the first sheet conveyance path to the second sheet conveyance path, wherein the confluence portion is provided with a conveyance rotating member with which a leading edge of the sheet comes into contact, and is connected to a drive transmission unit for transmitting drive to the conveyance rotating member, and a one-way clutch is arranged at the drive transmission unit, wherein the conveyance rotating member follows a change in a moving speed of the leading edge of the sheet after collision of the leading edge of the sheet with the conveyance rotating member by the one-way clutch.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
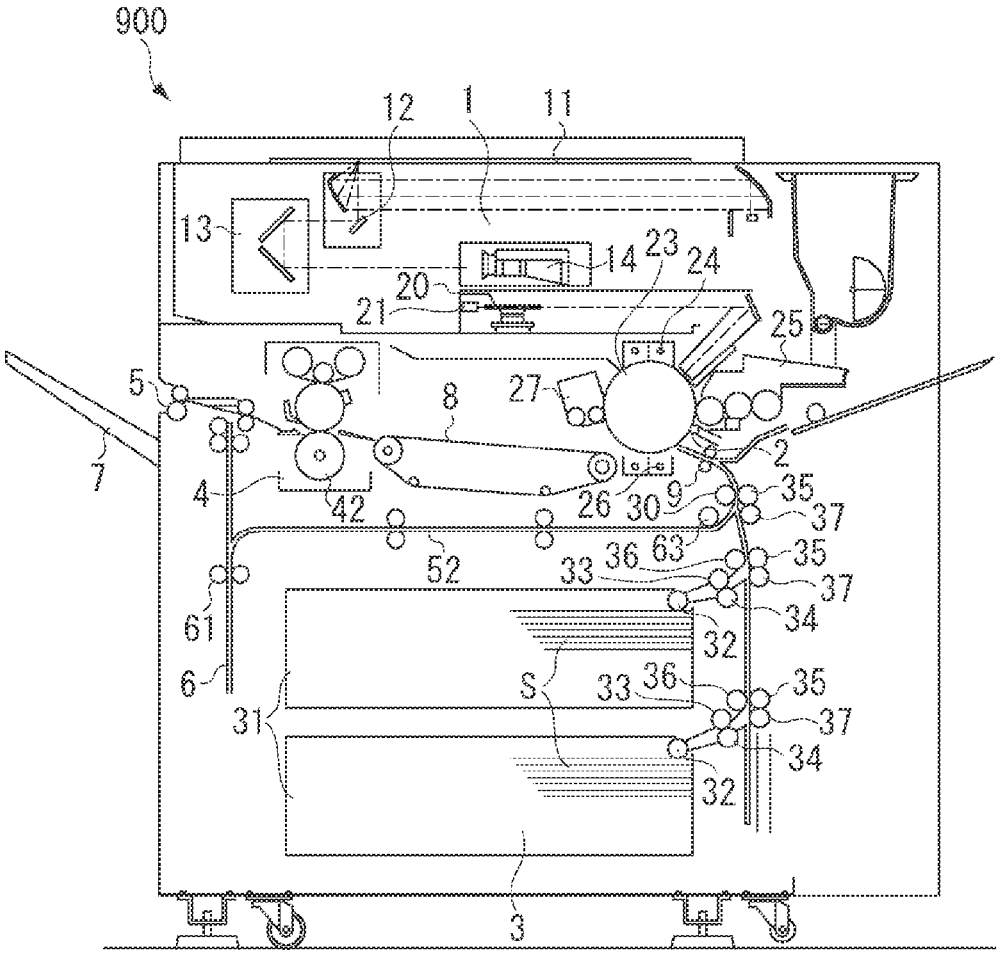
FIG. 1 is across section of an image forming apparatus equipped with a sheet conveying apparatus according to the present invention.

FIG. 1 is across section of an image forming apparatus 900 equipped with a sheet conveying apparatus according to the present invention. The image forming apparatus 900 includes a reader unit 1 for reading a document and an image forming unit 2 for forming an image (a toner image) based on the read document. Further, the image forming apparatus 900 includes a feeding unit 3 for feeding a sheet to the image forming unit 2, a fixing unit 4 for fixing a toner image formed on the sheet at the image forming unit 2, an external discharge roller pair 5 for discharging the sheet on which the toner image is fixed, and a reversing unit 6 for reversing the sheet on which the toner image is fixed. Description is made below from the reader unit 1 in turn.

[Reader Unit 1]

A document laid on a document positioning glass plate 11 is irradiated with light by a scanning optical system 12 including a light source and a reflection mirror group. The reflection light is formed as an image on a charge coupled device (CCD) 14 via a reduction lens 13, opto-electrically converted, and converted analog to digital (A/D).

[Image Forming Unit 2]

A laser emitting unit 21 scans a photosensitive drum 23 with a laser beam by the rotation of a polygon mirror 20 based on image information read by the reader unit 1 to form a latent image on the photosensitive drum 23 previously charged with a charging device 24. A developing unit 25 develops the latent image and forms a toner image on the photosensitive drum 23. A transfer charging device 26 transfers the toner image formed on the photosensitive drum 23 onto the sheet S. After the toner image is transferred, a cleaning unit 27 removes toner remained on the drum surface.

[Feeding Unit 3]

A sheet cassette 31 for stacking and storing the sheet S is detachably attached to the lower part of the image forming apparatus 900. A pickup roller 32 is arranged at the upper part of the sheet cassette 31. A feed roller 33 rotating to a direction in which the sheet is fed and a retard roller 34 rotating to a direction in which the sheet is returned via a torque limiter are arranged on the downstream side of the sheet cassette 31. The sheet S fed by the pickup roller 32 is separated and conveyed by the feed roller 33 and the retard roller 34. After that, the sheet S is subjected to a skew correction by a registration unit 9 and conveyed to the image forming unit 2.

[Fixing Unit 4]

The sheet S onto which the toner image is transferred at the image forming unit 2 is conveyed to the fixing unit 4 by the conveyance belt 8. The fixing unit 4 is formed of a roller pair 42 including a heating roller having a halogen heater (not illustrated) therein and a pressure roller pressed against the heating roller with a predetermined pressure force by a spring (not illustrated). The sheet on which toner yet to be fixed is laid passes through a nip portion of the roller pair 42 of the heating roller and the pressure roller and is applied heat and pressure to fuse the toner image. In the case of a one-sided copy mode, the sheet S already subjected fixing process is discharged outside the main body of the apparatus by the external discharge roller pair 5 and stacked onto a discharge tray 7.

[Reversing Unit 6]

In the case of a two-sided copy mode, the sheet S passes through the fixing unit 4 and then is conveyed to the reversing unit 6 by a switchback roller pair 61. The sheet S is conveyed to a two-sided conveyance path 62 by the reverse of the switchback roller pair 61, further conveyed by a refeed roller 63 to the registration unit 9 for again forming an image. Thereafter, the sheet S is discharged outside the main body of the apparatus via the same process as the one in the one-sided copy mode.

[Configuration of Conveyance Unit]

Figure 2:
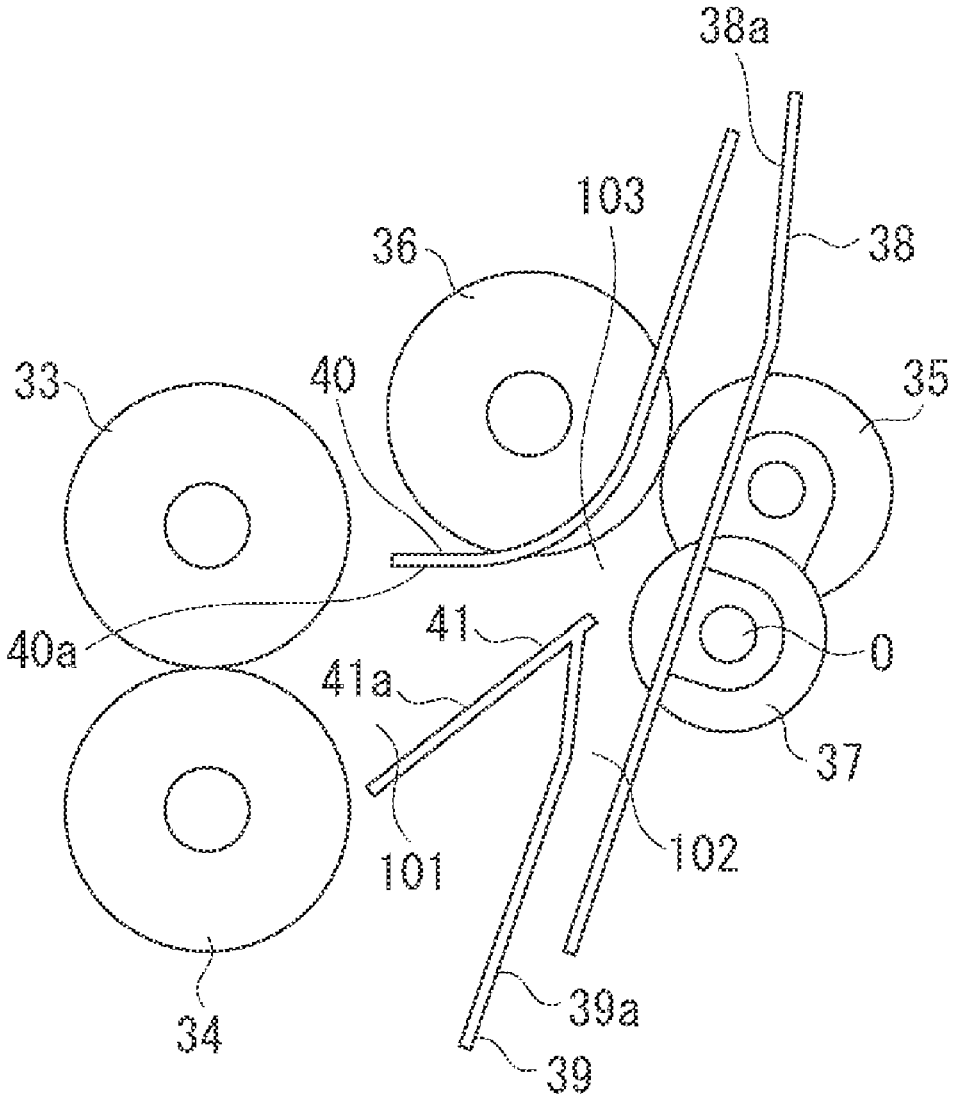
FIG. 2 is across section illustrating a configuration of the present invention.

The sheet conveying apparatus to which the present invention is applied is described below with reference to FIG. 2. The sheet conveying apparatus of the present invention includes a first sheet conveyance path 101 for guiding the sheet S fed from the sheet cassette 31 and separated to a single sheet by the feed roller 33 and the retard roller 34 and a second sheet conveyance path 102 for guiding the sheet S conveyed from the lower part to the upper part. The sheet conveying apparatus is further provided with a confluence portion 103 of the first sheet conveyance path 101 and the second sheet conveyance path 102. A first sheet conveyance unit according to the present invention is formed of the feed roller 33 and the retard roller 34.

The sheet S conveyed from the first sheet conveyance path 101 passes through the confluence portion 103 and guided to the second sheet conveyance path 102. The confluence portion 103 is formed so as to be encompassed with a conveyance guide surface 38*a* of a conveyance guide 38, a conveyance guide surface 39*a* of a conveyance guide 39, a conveyance guide surface 40*a* of a conveyance guide 40, and a conveyance guide surface 41*a* of a conveyance guide 41. The conveyance guide surface 38*a* is the one for forming the second sheet conveyance path 102 and positioned such that the first sheet conveyance path 101 intersects the conveyance guide surface 38*a* when extended.

The conveyance guide surface 39*a* forms an upstream part of the second sheet conveyance path 102 with respect to the confluence portion 103. The conveyance guide surface 40*a* forms a downstream part of the first sheet conveyance path 101 and a downstream part of the second sheet conveyance path 102 with respect to the confluence portion 103. The conveyance guide surface 41*a* forms the downstream part of the first sheet conveyance path 101. The conveyance guide surfaces 39*a* and 41*a* forms a part of the confluence portion 103 and positioned at the upstream side of the conveyance guide surface 40*a* in the sheet conveyance direction in which the sheet S is conveyed to the second sheet conveyance path 102.

Figure 7:
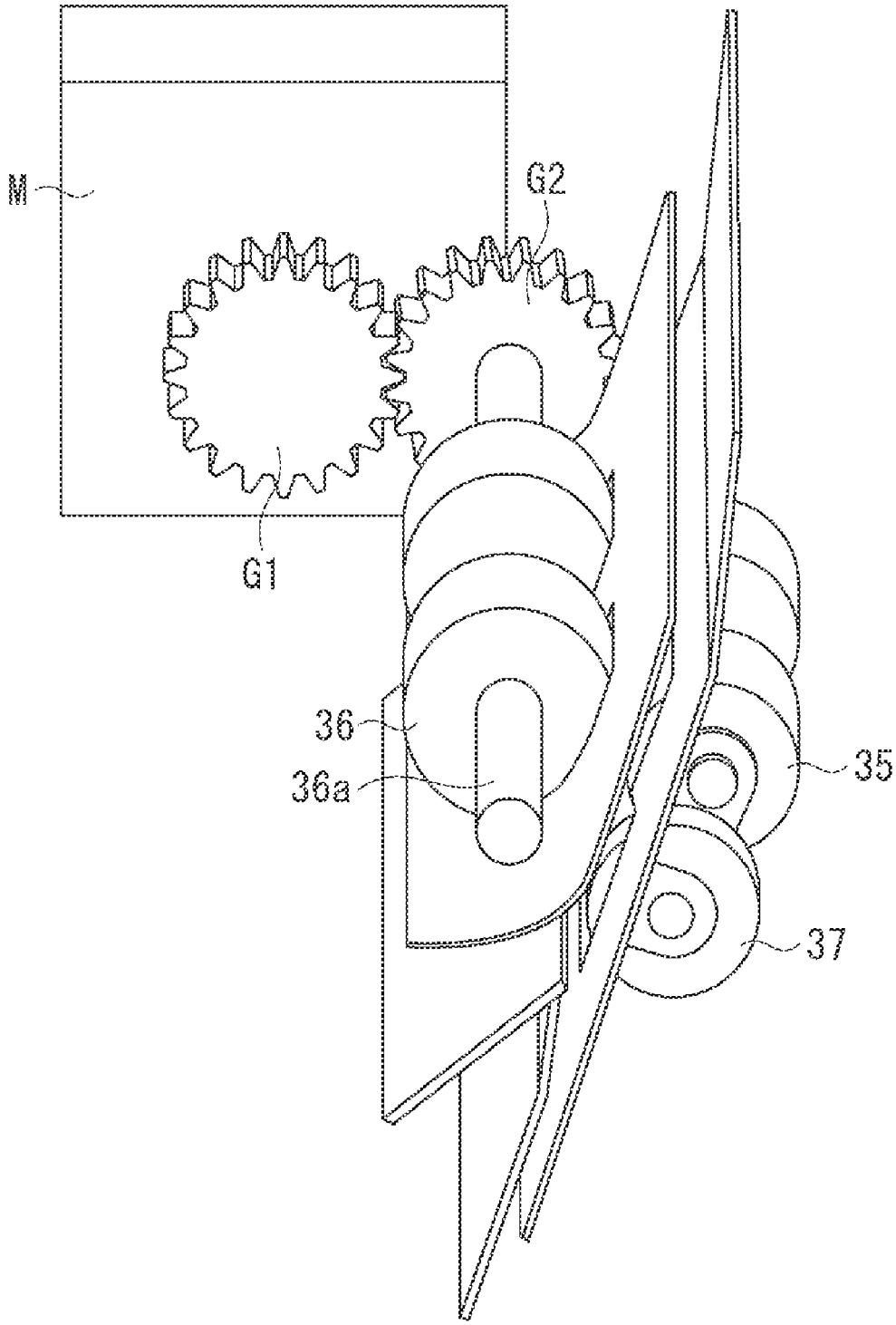
FIG. 7 is a perspective view of a drive source.

Conveyance rollers 35 and 36 forming a second sheet conveyance unit are provided downstream in the sheet conveyance direction with respect to the confluence portion 103 and convey the sheet S conveyed from the first sheet conveyance path 101 to the second sheet conveyance path 102. As illustrated in FIG. 7, the conveyance roller 36 is connected with a motor gear G1, an axial gear G2, and a conveyance roller axis 36*a* which form a drive transmission unit and rotated by a drive force transmitted from a motor M serving as a drive force. The conveyance roller 35 is press contacted to the conveyance roller 36 and driven by the conveyance roller 36 or the sheet conveyed between the conveyance rollers 35 and 36.

An elastic sponge roller 37 (elastic roller) as a conveyance rotating member on which the leading edge of the sheet S conveyed from the first sheet conveyance path 101 abuts is rotatably arranged upstream in the sheet conveyance direction of the conveyance rollers 35 and 36 on the second sheet conveyance path 102.

A rotational axis line as a rotational center O of the sponge roller 37 is positioned to be orthogonal to the sheet conveyance direction on the second sheet conveyance path 102 and to sandwich the conveyance guide surface 38*a* with the second sheet conveyance path 102. The material of the sponge of the sponge roller 37 is polyether series urethane. Asker F hardness thereof is approximately 65°. The material of the conveyance roller 36 is silicon. The hardness thereof is approximately 60° Hs JIS A. The material of the conveyance roller 35 is synthetic resin such as polyacetal resin (POM). The hardness thereof is higher than that of the sponge material of the sponge roller 37.

Figure 3:
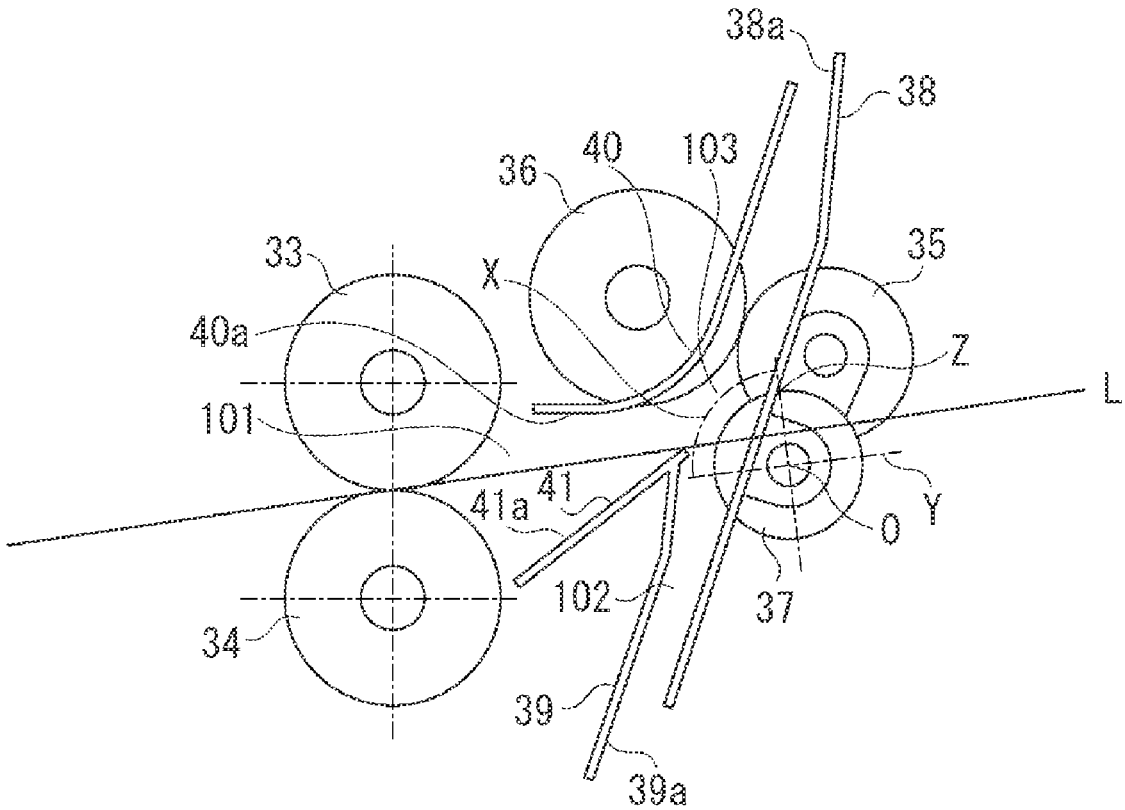
FIG. 3 is a cross section illustrating an arrangement of a sponge roller of the present invention.

As illustrated in FIG. 3, the rotational center O of the sponge roller 37 is positioned upstream in the sheet conveyance direction on the second sheet conveyance path 102 with respect to a line L passing through a nip point between the feed roller 33 and the retard roller 34 and contacting the conveyance guide surface 41*a*. More specifically, the sponge roller 37 is positioned so that the leading edge of the sheet S conveyed from the first sheet conveyance path 101 contacts the upper left part (or an area X indicated by an alternate long and short dash line in FIG. 3) of the sponge roller 37.

In FIG. 3, a line parallel to the line L and passing through the rotational center O is taken as Y and a line perpendicular to the line L and passing through the rotational center O is taken as Z. The area X is the one where the sponge roller 37 is rotated so as to guide the leading edge of the sheet S to the direction of the nip portion between the conveyance rollers 35 and 36 by the leading edge of the sheet S contacting the sponge roller 37 in the area where the sponge roller 37 is divided to four portions with the lines Y and Z.

Figure 6:
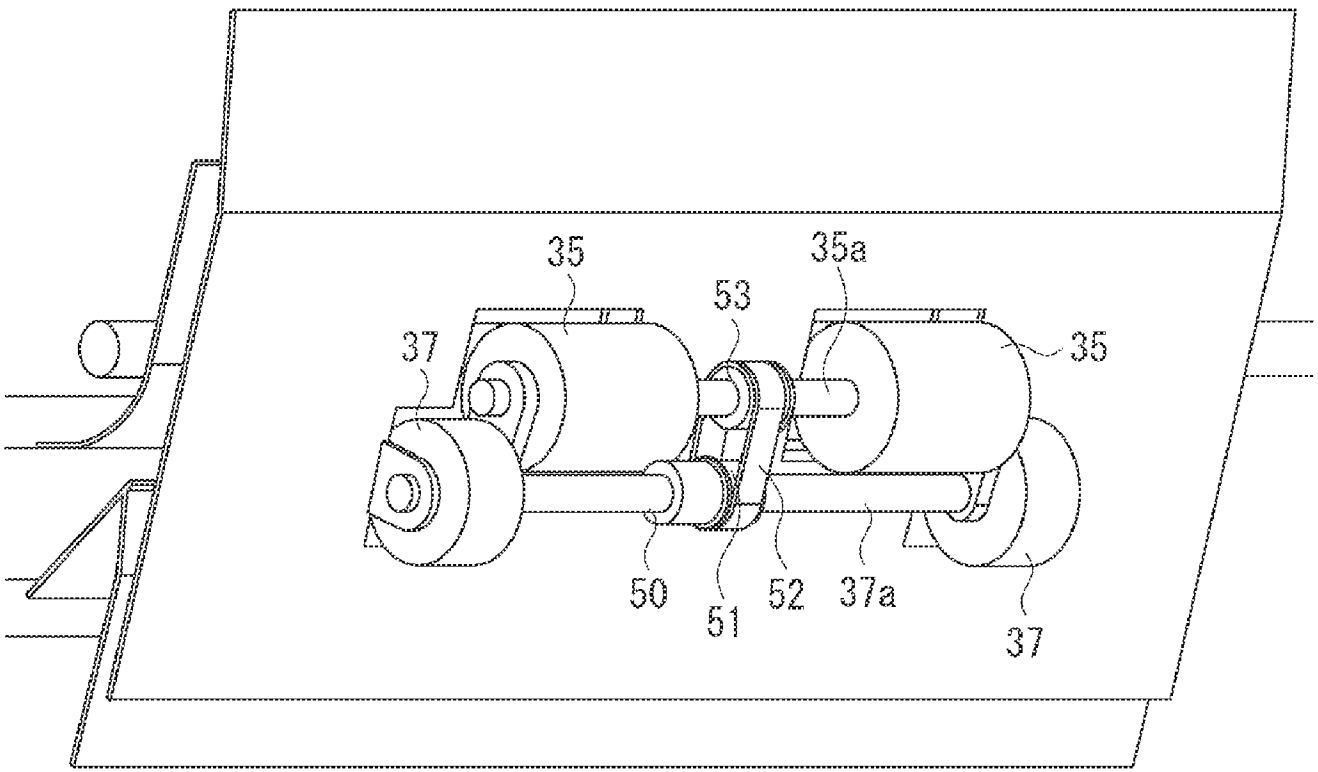
FIG. 6 is a perspective view illustrating a drive configuration of the sponge roller.

As illustrated in FIG. 6, the sponge roller 37 is coupled to the conveyance roller axis 36*a* via a sponge roller axis 37*a*, a one-way clutch 50, a sponge roller axis pulley 51, a timing belt 52, and a conveyance roller axis pulley 53 which form a drive transmission unit. The one-way clutch 50 is provided between the sponge roller axis 37*a* and the sponge roller axis pulley 51. When the conveyance roller 35 is driven by the rotation of the conveyance roller 36, the rotation of the conveyance roller 35 is transferred to the sponge roller 37 via the timing belt 52 and the one-way clutch 50.

Figure 8:
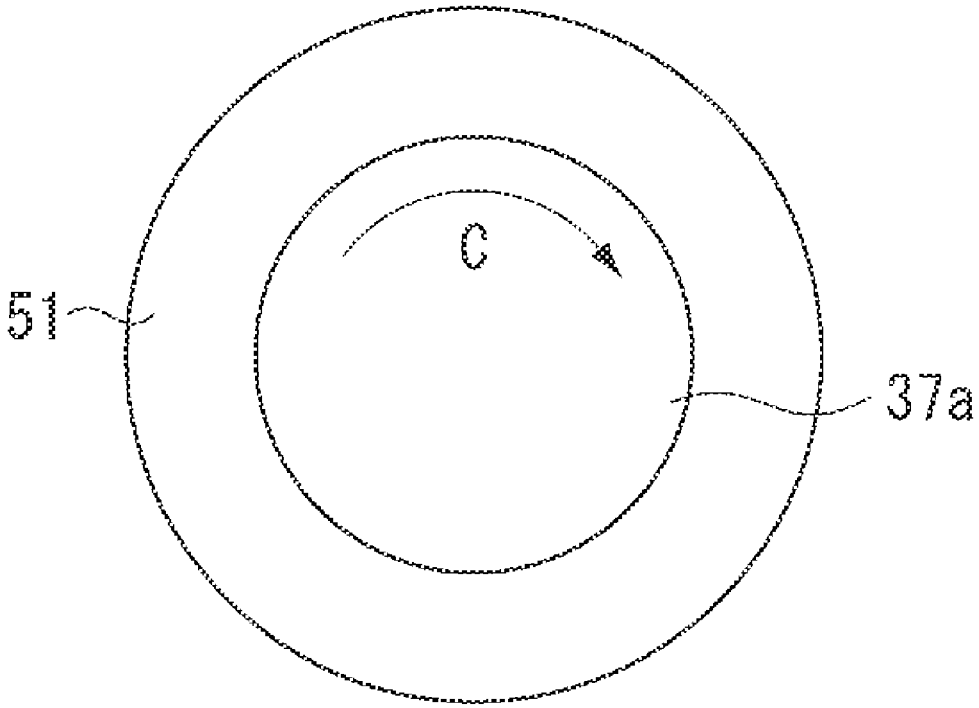
FIG. 8 is a schematic diagram illustrating a direction of lock of a one-way clutch according to a first exemplary embodiment of the present invention.

As illustrated in FIG. 8, a direction of rotation lock of the one-way clutch 50 and the sponge roller axis 37*a* is the one in which the sponge roller axis 37*a* is rotatable in the direction indicated by an arrow C with the one-way clutch 50 fixed. More specifically, if the rotation speed of the sponge roller 37 is faster than that transferred from the sponge roller axis 37*a*, the one-way clutch 50 allows the rotation.

Figure 4:
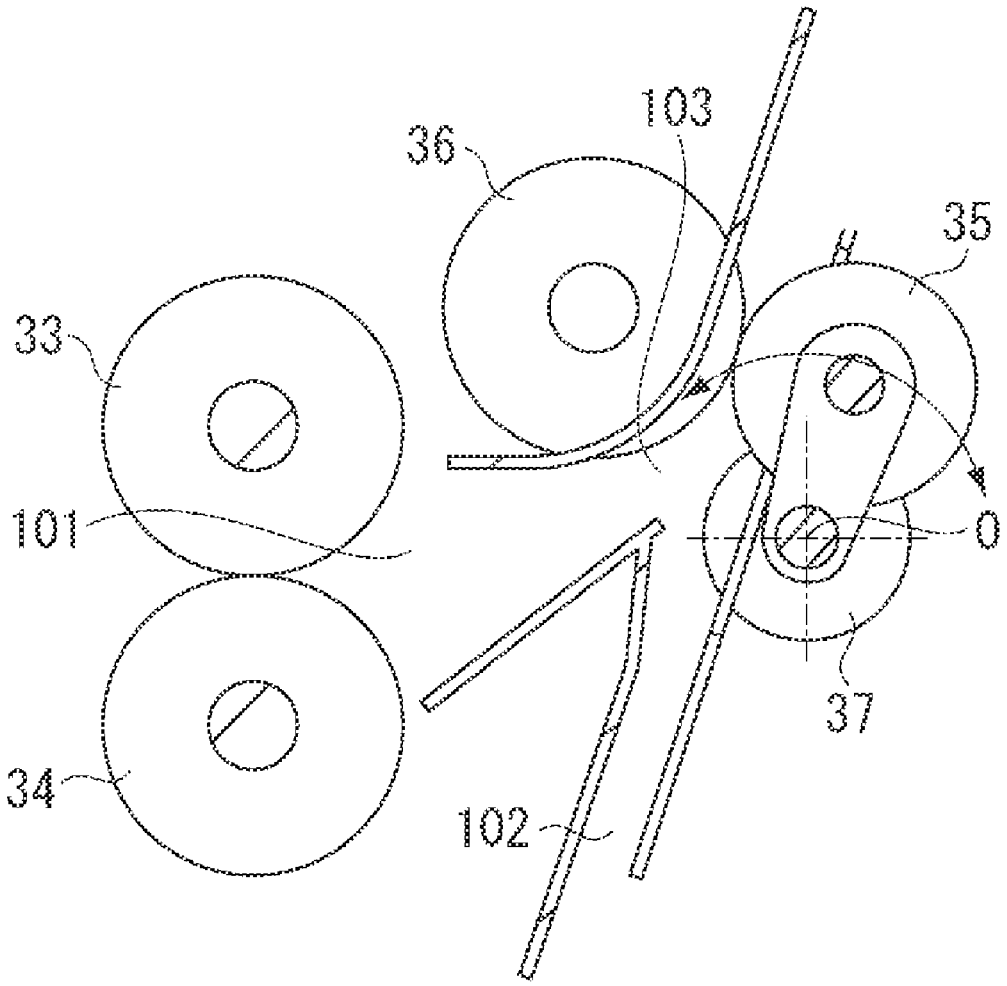
FIG. 4 is a cross section illustrating a method for supporting a conveyance roller.

As illustrated in FIG. 4, the conveyance roller 35 is rotatably supported with the center O of the sponge roller 37 as a rotation center and pressed in the direction of the conveyance roller 36 by a spring not illustrated. According to the above described configuration, the conveyance rollers 35 and 36 can sandwich and convey the sheet S. Further, a driving force is also transferred to the sponge roller 37 from the motor M as a drive source of the conveyance roller 36. A transmission ratio of the conveyance roller axis pulley 53 to the sponge roller axis pulley 51 is set so that the conveyance speeds of the conveyance roller 35, the conveyance roller 36, and the sponge roller 37 are equal to a conveyance speed V1. The conveyance speed of the feed roller 33 is also set to the conveyance speed V1.

Figure 5A:
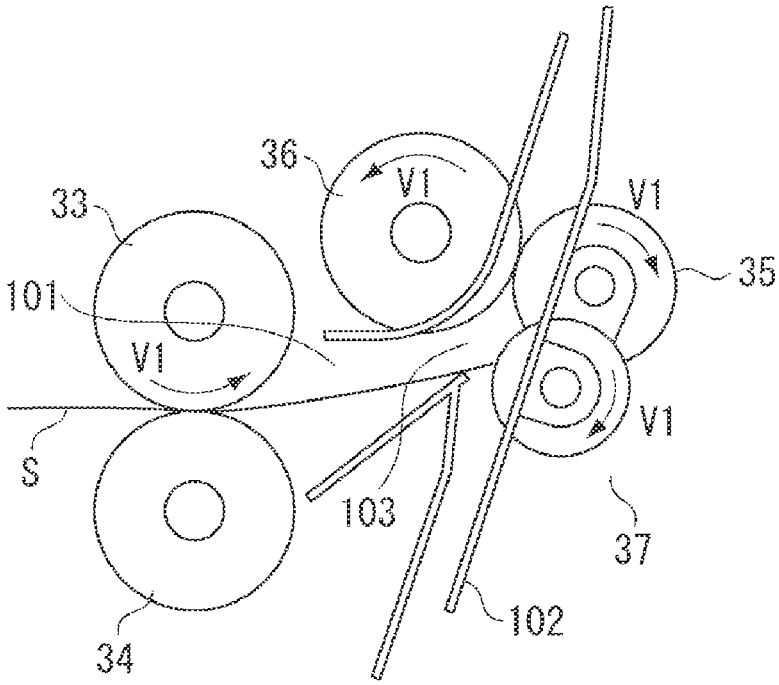
FIGS. 5A to 5C are cross sections illustrating a movement of a sheet.

The action of a first exemplary embodiment of the present invention is described below with reference to FIGS. 5A to 5C. As illustrated in FIG. 5A, when the sheet S is conveyed from the first conveyance path 101 to the second conveyance path 102 and further conveyed to the confluence portion 103, the leading edge of the sheet S collides with the sponge roller 37. Since a shock due to the collision of the leading edge of the sheet S can be absorbed by the elasticity of the sponge roller 37 of which hardness is lower than that of the materials of the conveyance rollers 35 and 36, production of a sound in collision can be effectively suppressed.

The rotational center O of the sponge roller 37 is positioned upstream in the sheet conveyance direction on the second sheet conveyance path 102 with respect to the line L drawn from the nip point between the feed roller 33 and the retard roller 34 to the conveyance guide surface 39*a* (refer to FIG. 3). For this reason, the leading edge of the sheet S contacts the sponge roller 37 to exert a clockwise rotating force (in the direction of an arrow C) on the sponge roller 37. The direction in which the sheet S colliding with the sponge roller 37 moves is changed along the periphery of the sponge roller 37.

When the leading edge of the sheet S conveyed at the conveyance speed V1 by the feed roller 33 and the retard roller 34 collides with the sponge roller 37 and the conveyance direction thereof is changed, the leading edge of the sheet S is moved at a speed V2 faster than the conveyance speed V1 (V1<V2) and moves upward. When the leading edge of the sheet S collides with the sponge roller 37 to change the conveyance direction to the direction along the periphery of the sponge roller 37, a large stiffness of the sheet does not bend the sheet very much. Therefore, the moving speed of the leading edge of the sheet S is faster than the conveyance speed V1. The larger the stiffness of the sheet, the less the sheet is bent, so that the moving speed of the leading edge of the sheet S becomes faster after the leading edge of the sheet S collides with the sponge roller 37.

Figure 5B:
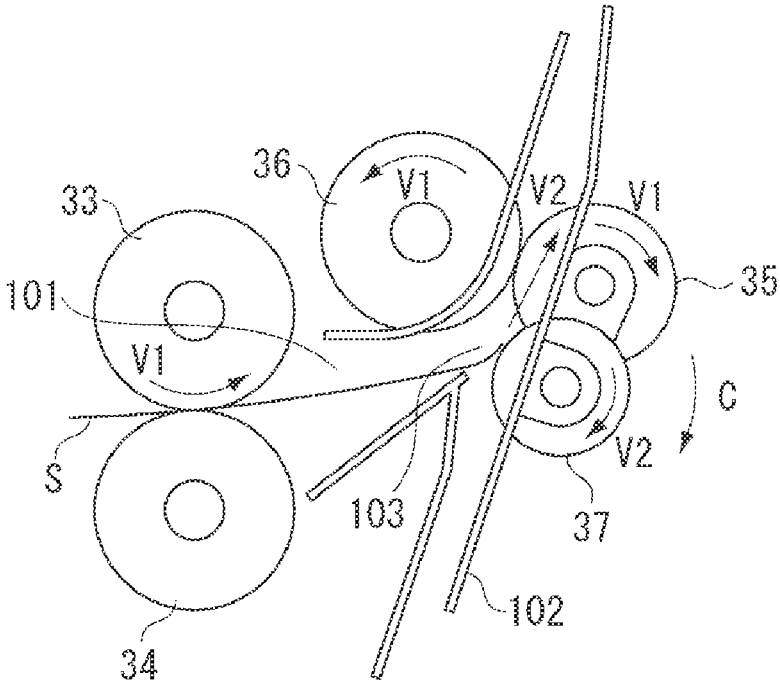

As illustrated in FIG. 5B, the sponge roller 37 is rotatable in the direction of the arrow C by the one-way clutch 50, so that the sponge roller 37 is rotated at the conveyance speed V2 while following the moving speed V2 of the leading edge of the sheet S after the collision of the leading edge of the sheet S with the sponge roller 37. Thus, the sponge roller 37 is configured to follow the moving speed V2 even if the moving speed of the leading edge of the sheet S becomes faster than the speed at which the sheet S is conveyed by the feed roller 33 and the retard roller 34 after the sheet S collides with the sponge roller 37. This prevents the leading edge from being bent when the leading edge of the sheet S collides with the sponge roller 37.

Figure 5C:
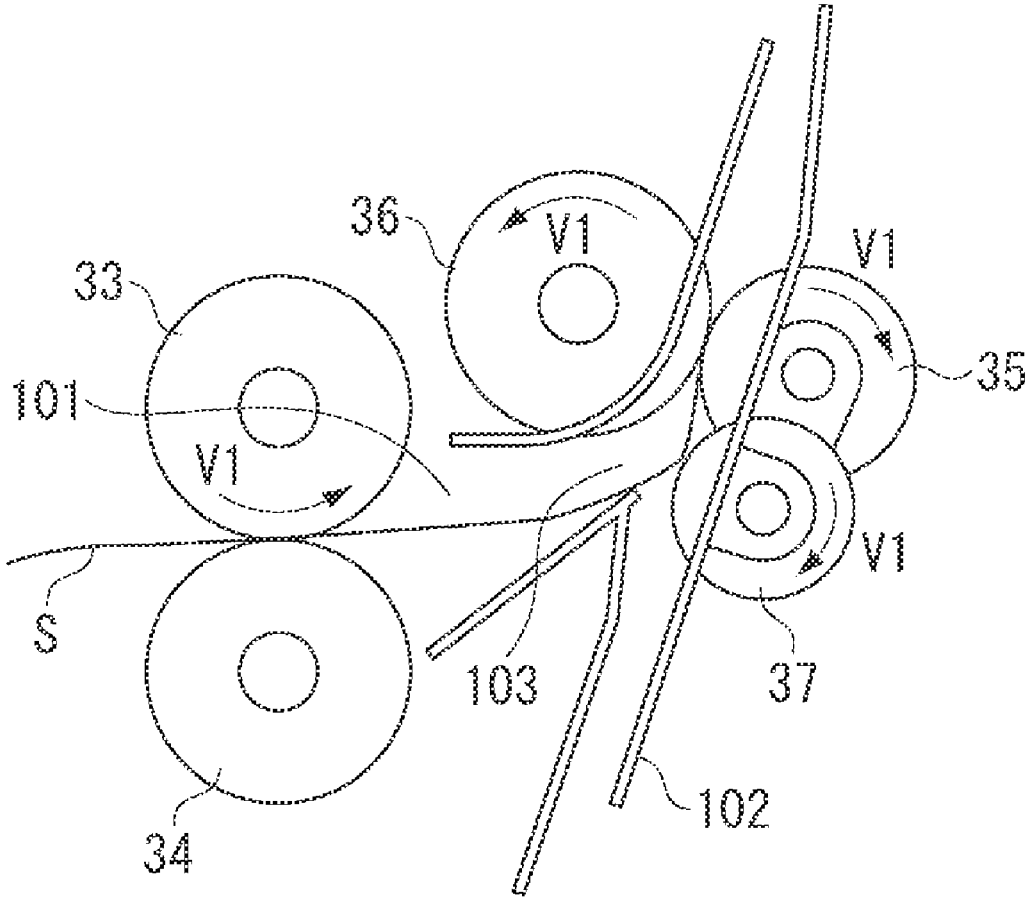

After that, as illustrated in FIG. 5C, the leading edge of the sheet S is conveyed to the direction of the conveyance rollers 35 and 36. At this point, the conveyance speed of the sponge roller 37 is V1 and equal to the speed of the conveyance rollers 35 and 36 at which the sheet S is conveyed, so that the sheet S is conveyed without shock produced when the sheet S plunges into the nip. Then, the sheet S is nipped in the conveyance rollers 35 and 36 and conveyed downstream in the conveyance direction.

[Configuration of Conveyance Unit]

A sheet conveying apparatus to which a second exemplary embodiment of the present invention is applied is described below with reference to FIG. 10. Parts different from those in the first exemplary embodiment are described in detail below and the description of common parts is omitted.

Figure 11:
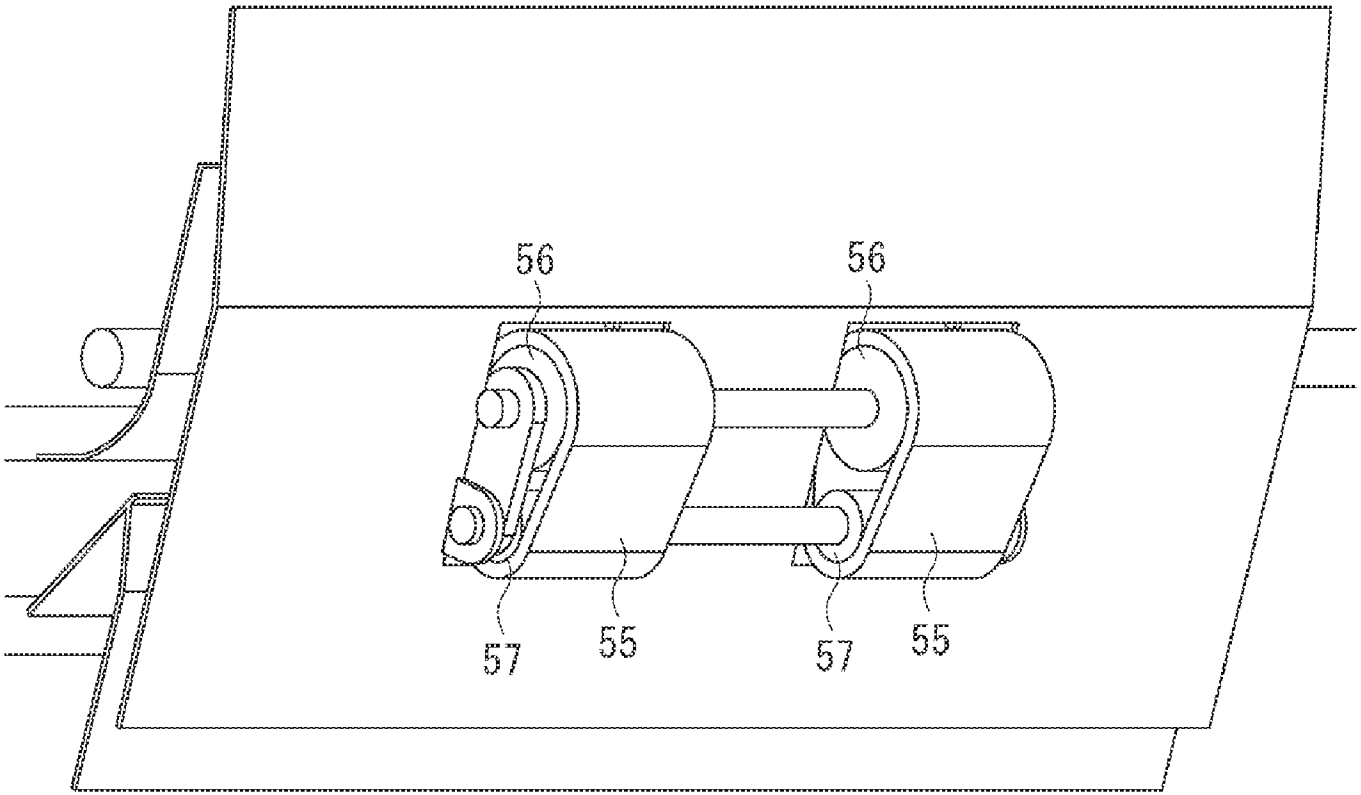
FIG. 11 is a perspective view illustrating a belt configuration of the second exemplary embodiment.

In the present exemplary embodiment, the conveyance roller 36 and a belt 55 which forms the second sheet conveyance unit are provided downstream in the sheet conveyance direction with respect to the confluence portion 103 and convey the sheet S conveyed from the first sheet conveyance path 101 to the second sheet conveyance path 102. As illustrated in FIG. 11, a belt 55 of an elastic body as a conveyance rotating member is stretched between a drive roller 56 facing to the conveyance roller 36 and a driven roller 57 arranged upstream in the conveyance direction.

Figure 9:
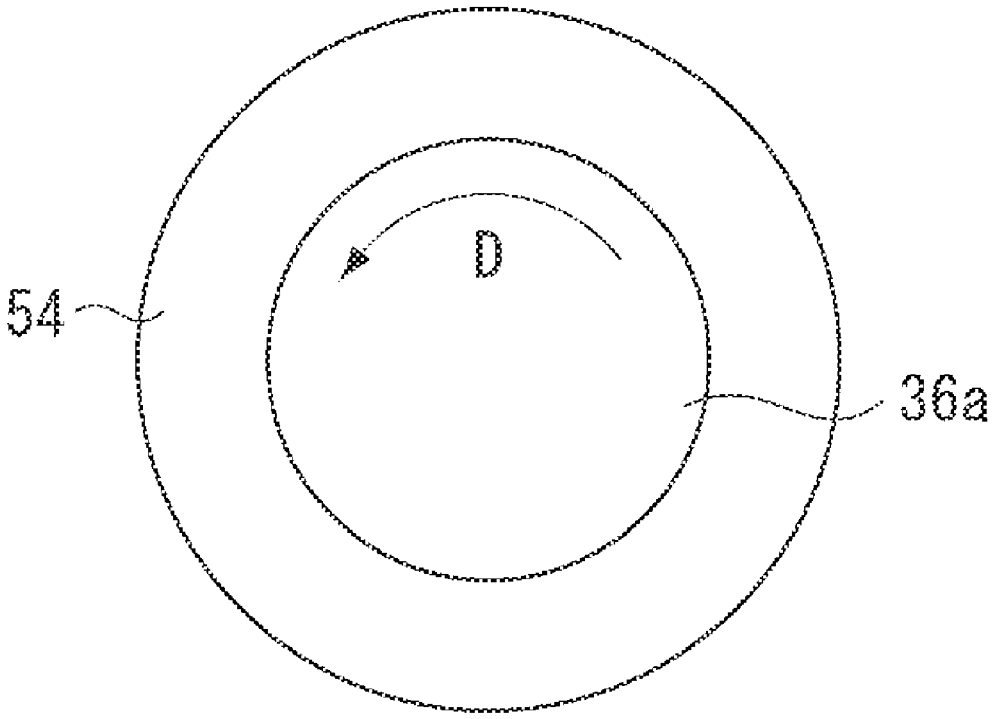
FIG. 9 is a schematic diagram illustrating a direction of lock of a one-way clutch according to a second exemplary embodiment of the present invention.
Figure 12:
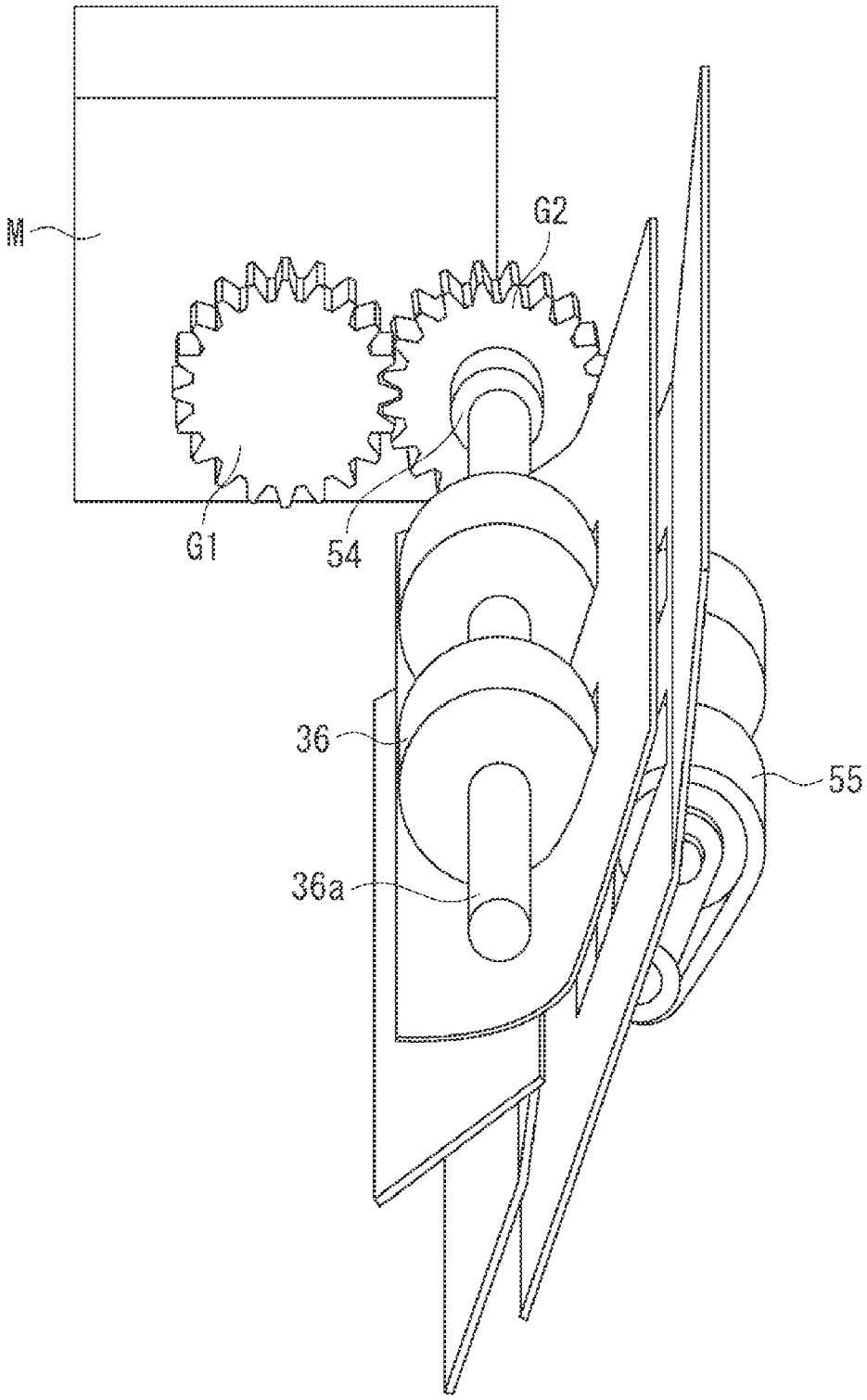
FIG. 12 is a perspective view of a drive source of the second exemplary embodiment.

As illustrated in FIG. 12, the conveyance roller 36 is connected with the motor gear G1, the axial gear G2, and the conveyance roller axis 36*a* which form the drive transmission unit and rotated by a drive force transmitted from the motor M serving as a drive force. A one-way clutch 54 is provided between the axial gear G2 and the conveyance roller axis 36*a*. As illustrated in FIG. 9, a direction of rotation lock of the one-way clutch 54 and the conveyance roller axis 36*a* is the one in which the conveyance roller axis 36*a* is rotatable in the direction indicated by an arrow D with the one-way clutch 54 fixed. More specifically, if the rotation speed of the belt 55 is faster than that of the conveyance roller 36 (the rotation speed of the axial gear G2), the one-way clutch 54 allows the rotation.

Figure 10:
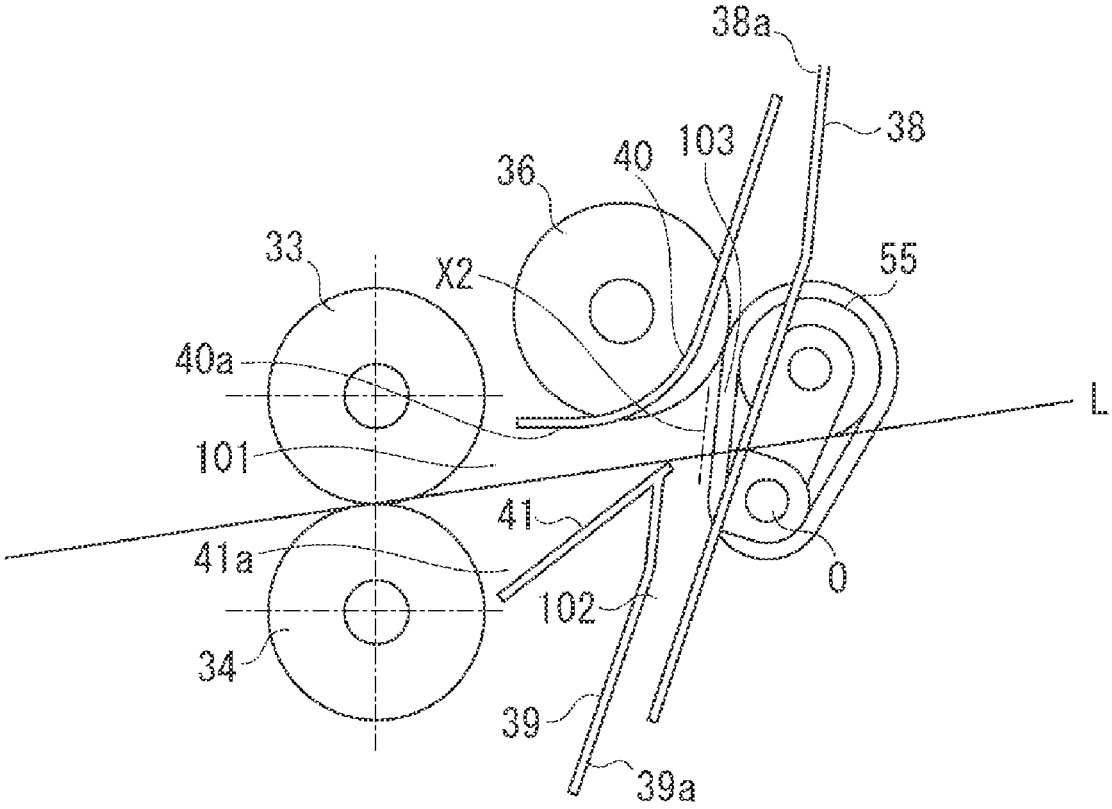
FIG. 10 is a cross section illustrating a configuration of the second exemplary embodiment.

As illustrated in FIG. 10, the drive roller 56 is rotatably supported with the center O of the driven roller 57 as a rotation center and pressed in the direction of the conveyance roller 36 by a spring not illustrated. According to the above described configuration, the conveyance roller 36 and the belt 55 can sandwich and convey the sheet S. At this point, the speeds of the belt and the conveyance roller are set to the conveyance speed V1. The conveyance speed of the feed roller 33 is also set to the conveyance speed V1.

The rotational center O of the driven roller 57 over which the belt 55 is stretched is positioned upstream in the sheet conveyance direction on the second sheet conveyance path 102 with respect to a line L drawn from the nip point between the feed roller 33 and the retard roller 34 to the conveyance guide surface 39*a* (refer to FIG. 10). This configuration causes the leading edge of the sheet S conveyed from the first sheet conveyance path 101 to abut on a tension portion X2 of the belt 55. The material of the belt 55 is ethylene propylene diene monomer (EPDM) rubber.

Figure 13A:
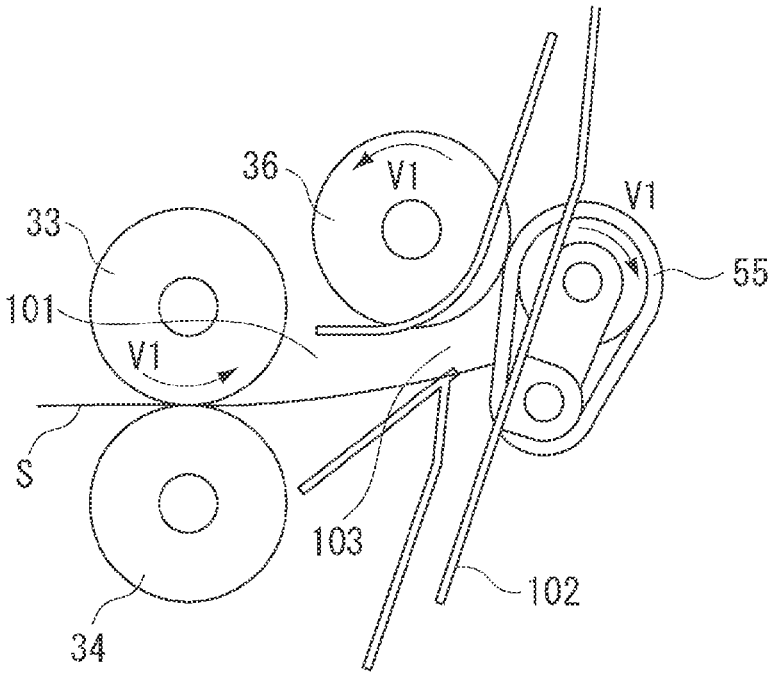
FIGS. 13A to 13C are cross sections illustrating a movement of a sheet according to the second exemplary embodiment.
Figure 13B:
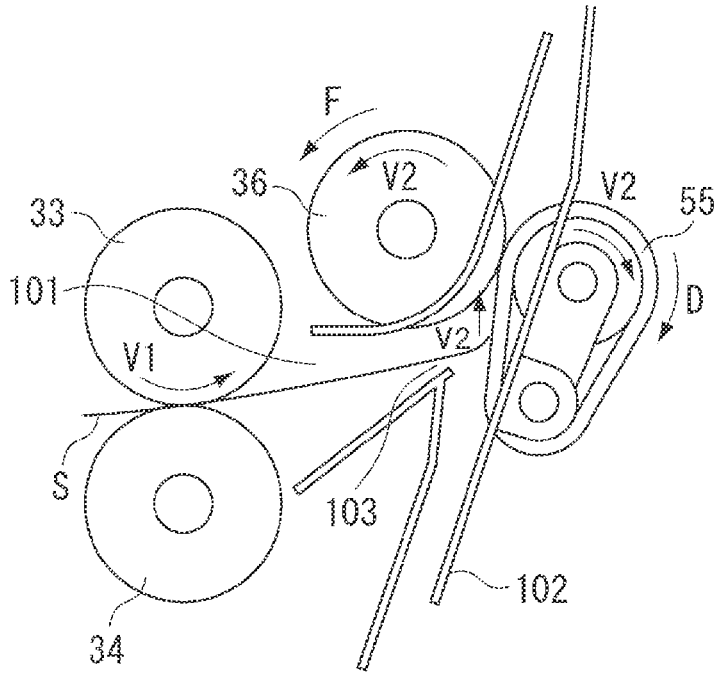

The action of the present exemplary embodiment is described below with reference to FIGS. 13A to 13C. As illustrated in FIG. 13A, when the sheet S is conveyed from the first conveyance path 101 to the second conveyance path 102 and further conveyed to the confluence portion 103, the leading edge of the sheet S collides with the belt 55. Since a shock due to the collision of the leading edge of the sheet S can be absorbed by the elasticity of tension of the belt 55, the production of a sound in collision can be suppressed.

As describe in the first exemplary embodiment, when the sheet S is conveyed at the conveyance speed V1 by the feed roller 33 and the retard roller 34, the leading edge of the sheet S is moved upward at the speed V2. A conveyance roller axis 35*a* is drivably connected to the motor M serving as the drive source via the one-way clutch 54, so that the conveyance roller 36 is rotatable in the direction of an arrow F with respect to the motor M. Consequently, the belt 55 is also rotatable in the direction of an arrow D.

As illustrated in 13B, when the speed of the leading edge of the sheet S is changed to the speed V2 and moves upward, the belt 55 and the conveyance roller 36 rotate at the moving speed V2 while following the moving speed V2 of the leading edge of the sheet S. Thus, the belt 55 is configured to follow the colliding leading edge to prevent the leading edge from being bent when the leading edge collides with the belt 55.

Figure 13C:
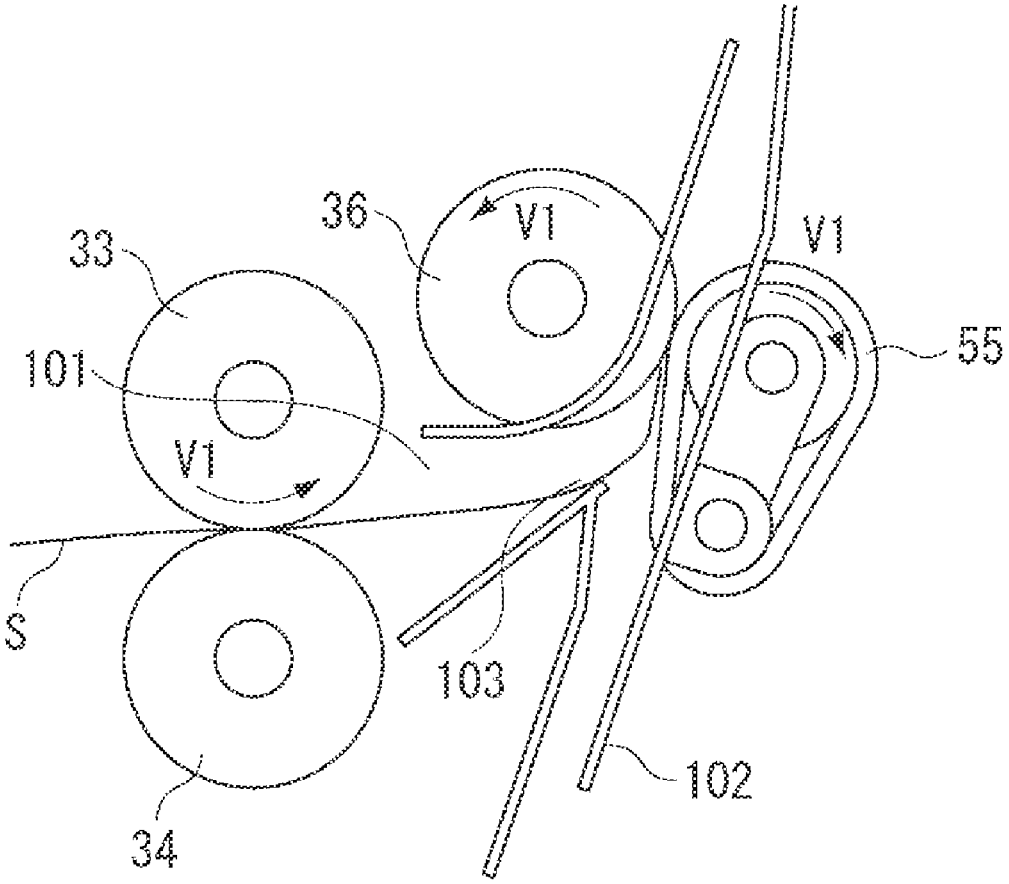

As illustrated in FIG. 13C, the leading edge of the sheet S is conveyed to the direction of the nip between the conveyance roller 36 and the belt 55. At this point, the conveyance speed of the belt 55 is V1. Then, the sheet S is nipped in the conveyance roller 36 and the belt 55 and conveyed downstream. The speed of the belt 55 and the leading edge of the sheet S is equal to each other, so that a shock is not produced when the sheet S plunges into the nip.

Figure 14:
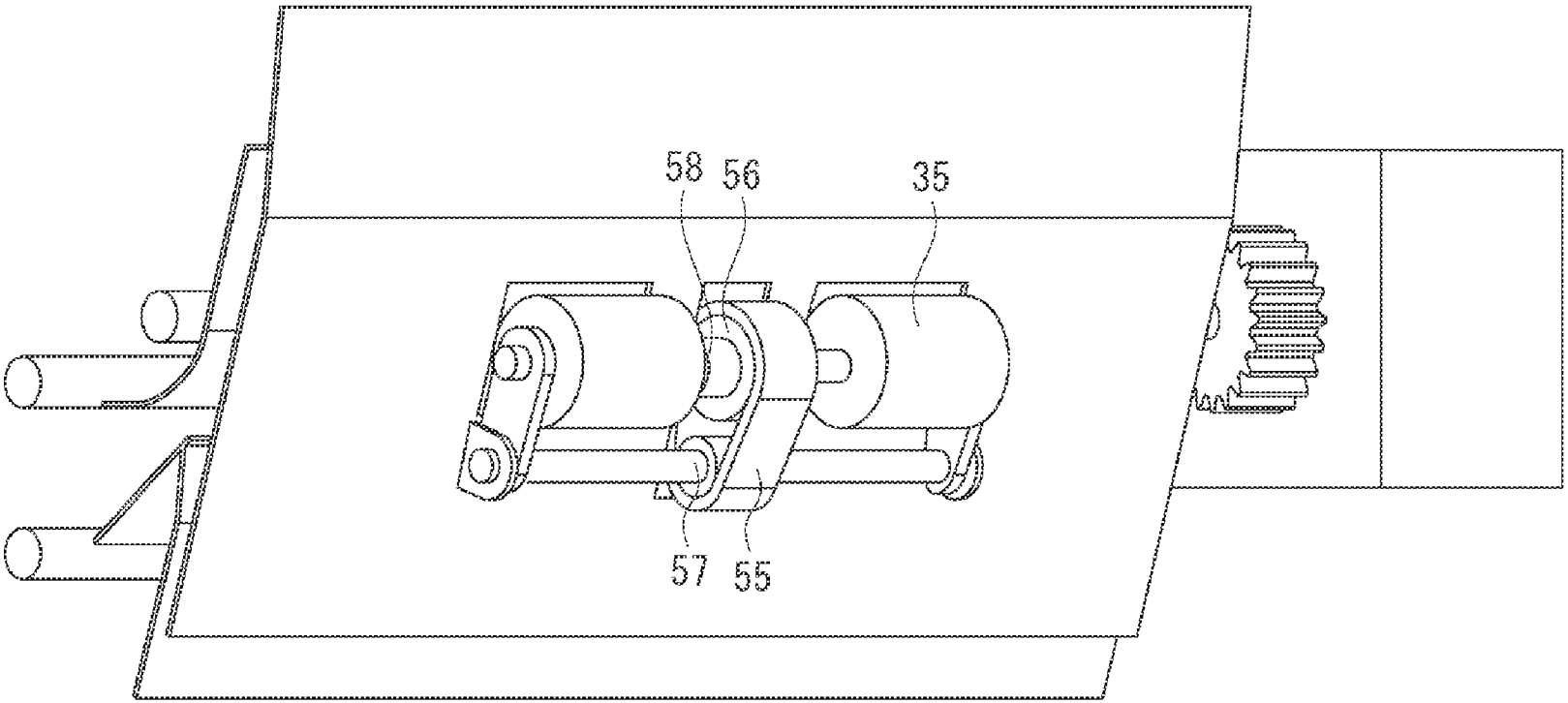
FIG. 14 is a perspective view illustrating a belt configuration of another exemplary embodiment.
Figure 15:
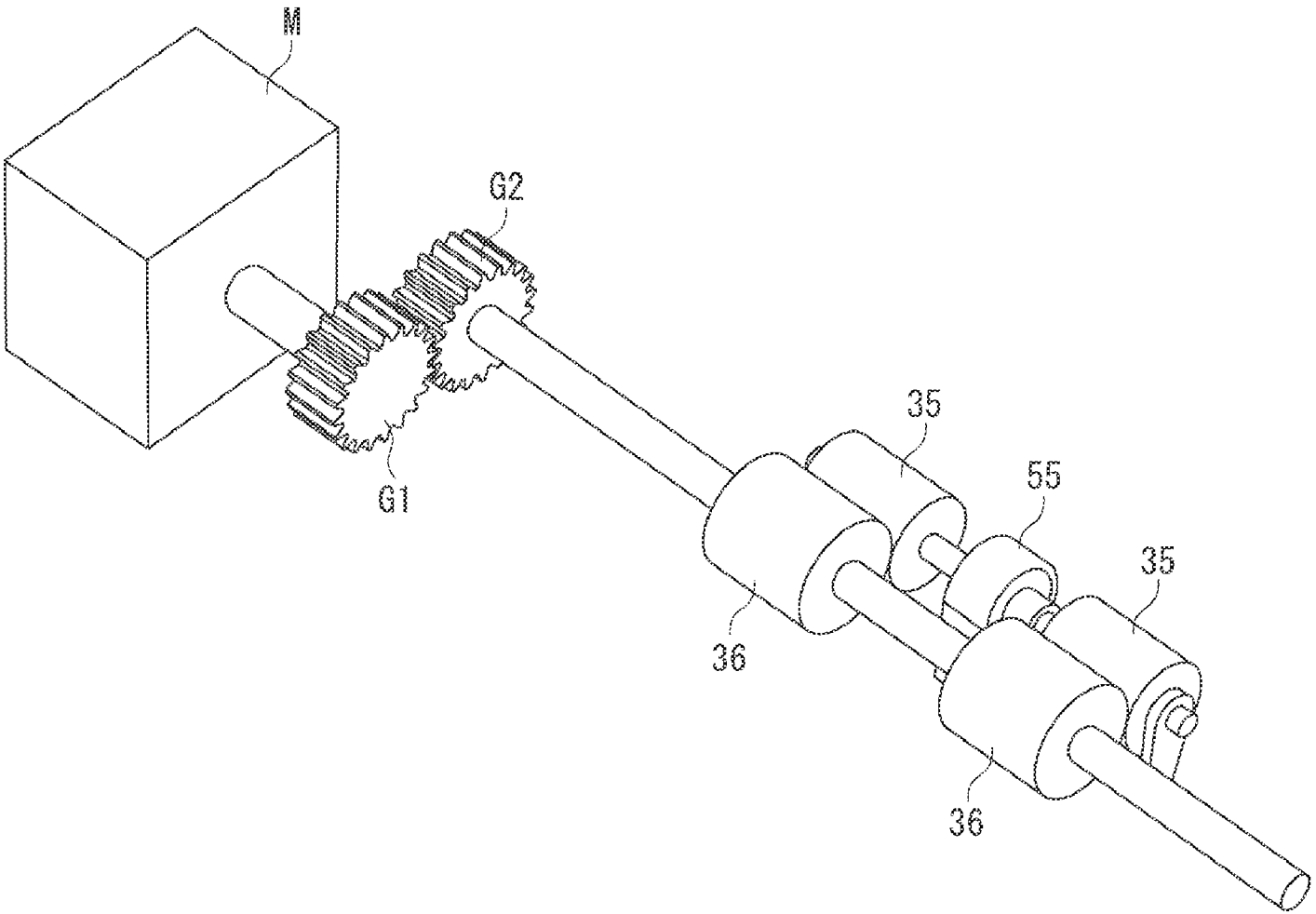
FIG. 15 is a perspective view of a drive source of another exemplary embodiment.

In the second exemplary embodiment, the belt 55 is provided to face to the conveyance roller 36. However, another configuration may be used. As illustrated in FIGS. 14 and 15, for example, the conveyance rollers 35 are provided at positions facing to the conveyance rollers 36 which are arranged left and right. The belt 55 of an elastic body as a conveyance rotating member may be arranged between a plurality of roller pairs which are formed of the conveyance roller 36 and the conveyance roller 35.

In this configuration, the belt 55 is stretched between the drive roller 56 and the driven roller 57. The drive roller 56 and the conveyance roller 35 are rotatably supported with a rotation axis 59 as a rotation center. The conveyance roller 35 is pressed against the conveyance roller 36 by a spring not illustrated. The belt 55 transmits a drive force to the conveyance roller axis 35*a* via the one-way clutch 58. Therefore, as illustrated in FIG. 8, the direction of lock of the one-way clutch 58 is the one in which the conveyance roller axis 35*a* is rotatable in the direction indicated by an arrow C with the one-way clutch 58 fixed (in the same direction as that in the first exemplary embodiment).

A driving force is transmitted from the motor M serving as the drive source to the conveyance roller 36 via the motor gear G1 and the axial gear G2 to rotate the conveyance roller 36. Further, the driving force rotates the belt 55 via the conveyance rollers 35, the conveyance roller axis 35*a*, and the one-way clutch 58.

In the configuration, since the belt 55 is not pressed against and contacted to the conveyance roller 36, a load from the conveyance roller 36 at the time of the collision of the leading edge of the sheet S is smaller than the one in the first and second exemplary embodiments to allow the belt 55 to further follow up the leading edge of the sheet S. The operation and effect are similar to those of the first and second exemplary embodiments, so that the description thereof is omitted.

In a third exemplary embodiment, an example is taken in which the sheet conveyance apparatus according to the present invention is used in an image reading apparatus.

Figure 16:
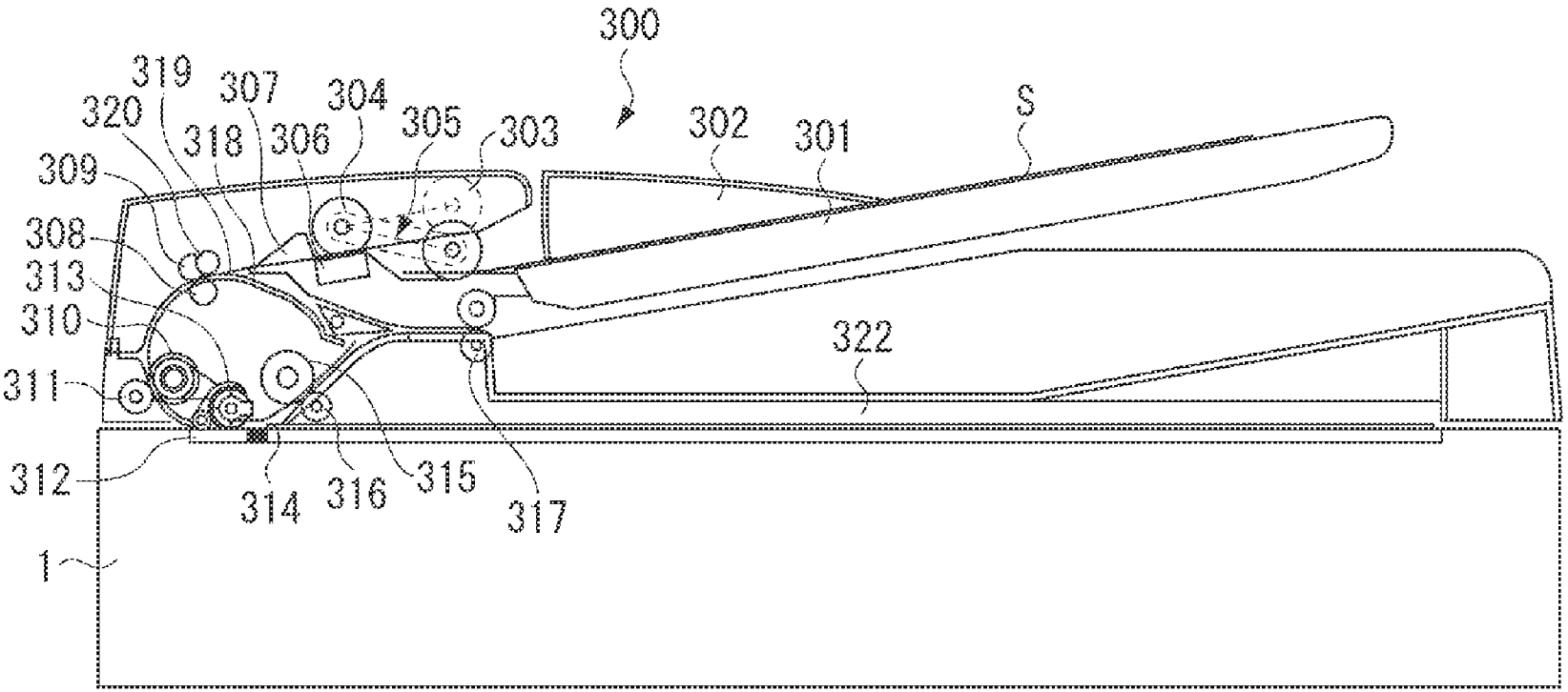
FIG. 16 is a cross section illustrating a configuration according to a third exemplary embodiment of the present invention.
Figure 17B:
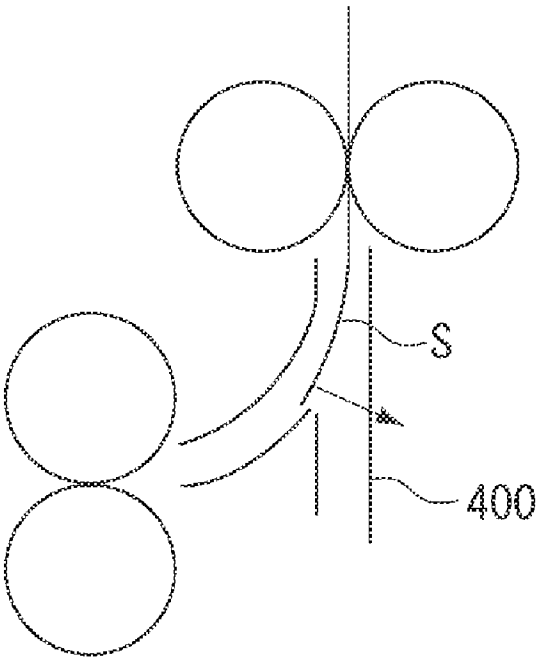
FIGS. 17A and 17B are schematic diagrams illustrating conventional problems.
Figure 17A:
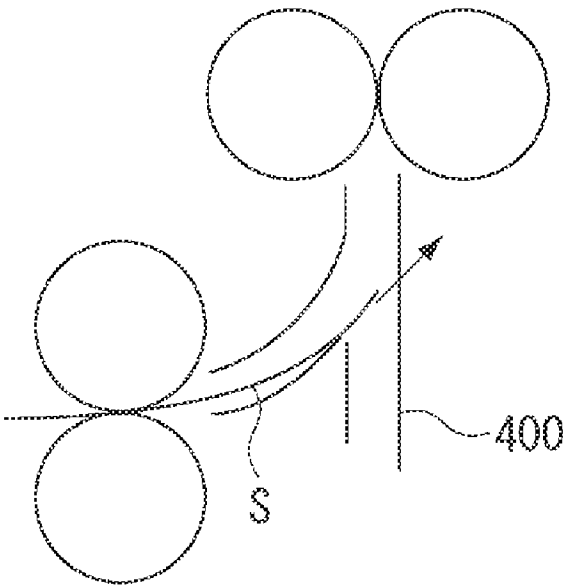

As illustrated in FIG. 16, the image reading apparatus according to the present exemplary embodiment includes a reader unit 1 serving as an image reading unit and an automatic document conveyance apparatus 300 as a sheet conveyance apparatus for automatically conveying a document to the reader unit 1.

The automatic document conveyance apparatus 300 is arranged at the upper part of the reader unit 1. The reader unit 1 is similar in configuration to that in the first exemplary embodiment (refer to FIG. 1), so that the description thereof is omitted.

In FIG. 16, a document tray 301 stacks the sheet S as a document. A pair of widthwise regulating plates 302 is sildably arranged on the document tray 301 in a width direction of the sheet S. The width direction of the sheet S stacked on the document tray 301 is regulated by the widthwise regulating plates 302 ensures the conveyance stability at the time of conveying the document.

A feeding roller 303 is provided at the upper part of the document tray 301. The feeding roller 303 feeds a document (hereinafter referred to as a sheet S) with a separation roller 304. The feeding roller 303 usually withdraws into the upper part (a position indicated by a dotted line in the drawing) being a home position to so as not to obstruct document setting work.

When a feeding operation is started, the feeding roller 303 descends to a position indicated by a solid line in the drawing and abuts on an upper surface of the sheet S. The feeding roller 303 is pivotally supported by an arm 305, so that the arm 305 is oscillated to move the feeding roller 303 upward and downward. A separation pad 306 is arranged on a position opposite to the separation roller 304 and applies pressure on the separation roller 304. The separation pad 306 is formed of a rubber material somewhat smaller in friction than the separation roller 304. The separation pad 306 separates the sheets S fed by the feeding roller 303 one by one and the separated sheet S is fed by the separation roller 304.

A registration roller 308 and a registration driven roller 309 are positioned at the downstream of a first sheet conveyance path 307 and serves as a skew correction unit for aligning the leading edge of the sheet S fed by the separation roller 304. The leading edge of the sheet S plunges into the nip portion between the registration roller 308 and the registration driven roller 309 which are still and then the sheet S is further conveyed by the separation roller 304 to form a loop, correcting the skew thereof.

The sheet S is conveyed by a lead roller 310 and a lead driven roller 311 to a platen glass 312. The sheet S conveyed to the platen glass 312 is scooped up by a jump stand 314 via a platen roller 313 and conveyed by a lead discharge roller 315 and a lead discharge driven roller 316.

When an image reading operation of the sheet S is finished by a scanning optical system 12 moved to the lower part of the platen glass 312, the sheet S is discharged to a sheet discharge tray 322 by a discharge roller pair 317. In the case of a two-sided reading mode, the sheet S is switched back without being discharged by the discharge roller pair 317, guided to a second sheet conveyance path 318, and conveyed to the registration roller 308 and the registration driven roller 309. When the sheet S reaches the registration roller 308 and the registration driven roller 309, the other surface of the sheet S is read similarly to the above manner.

A sponge roller 320 is arranged at a confluence portion of first and second sheet conveyance paths 307 and 318. For the sponge roller 320, the second sheet conveyance path 318 corresponds to the first sheet conveyance path of the present invention and the first sheet conveyance path 307 corresponds to the second sheet conveyance path of the present invention.

Since the leading edge of the sheet S conveyed from the first sheet conveyance path 307 abuts on the sponge roller 320, a shock caused by abutment is absorbed by the elasticity of the sponge roller 320. Thus, a sound produced by the leading edge of the sheet S colliding with the registration driven roller 309 can be suppressed. Similarly, since the leading edge of the sheet S conveyed from the second sheet conveyance path 318 also abuts on the sponge roller 320, a shock caused by abutment is absorbed by the elasticity of the sponge roller 320 to allow a sound produced by collision to be suppressed.

The sponge roller 320 and the registration driven roller 309 are alternately arranged in the direction perpendicular to the sheet conveyance direction along the first sheet conveyance path 307. More specifically, the peripheries of the sponge roller 320 and the registration driven roller 309 are partially superposed on each other on the first sheet conveyance path 307 on a projection plane in the direction perpendicular to the sheet conveyance direction along the first sheet conveyance path 307. The effect obtained in such a configuration is similar to that in a position relationship between the peripheries of the sponge roller 37 and the conveyance roller 35 described in the first exemplary embodiment, so that the description thereof is omitted.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-278964 filed Dec. 8, 2009, which is hereby incorporated by reference herein in its entirety.

What is claimed is:

1. A sheet conveying apparatus comprising:

a confluence portion formed by a first sheet conveyance path joining in a second sheet conveyance path;

a first sheet conveyance unit which is provided at an upstream side of the confluence portion and configured to convey a sheet in the first sheet conveyance path; and a second sheet conveyance unit which is provided at a downstream side of the confluence portion and configured to convey the sheet conveyed from the first sheet conveyance path to the second sheet conveyance path, wherein the confluence portion is provided with a conveyance rotating member with which a leading edge of the sheet comes into contact, and is connected to a drive transmission unit configured to transmit drive to the conveyance rotating member, and a one-way clutch is arranged at the drive transmission unit, and wherein the conveyance rotating member follows a change in a moving speed of the leading edge of the sheet after collision of the leading edge of the sheet with the conveyance rotating member by the one-way clutch.

2. The sheet conveying apparatus according to claim 1, wherein a driving force of a drive source at the second sheet conveyance unit is transmitted to the conveyance rotating member by the drive transmission unit.

3. The sheet conveying apparatus according to claim 1, wherein the conveyance rotating member is a sponge roller.

4. The sheet conveying apparatus according to claim 1, wherein the second sheet conveyance unit is provided with a driven conveyance roller and a conveyance roller pressed against and contacting the driven conveyance roller, and the drive is transmitted from the conveyance roller to the conveyance rotating member.

5. The sheet conveying apparatus according to claim 1, wherein the second sheet conveyance unit is provided with a driven conveyance roller and a drive roller facing the driven conveyance roller, and the conveyance rotating member is a belt stretched between the drive roller and a driven roller arranged upstream of the drive roller in the conveyance direction.

6. The sheet conveying apparatus according to claim 5, wherein the belt is pressed against and contacts the driven conveyance roller.

7. The sheet conveying apparatus according to claim 1, wherein the second sheet conveyance unit includes a plurality of roller pairs formed of driven conveyance rollers and conveyance rollers pressed against and contacting the driven conveyance rollers, the conveyance rotating member is formed of a belt stretched between a drive roller and a driven roller, and the belt is arranged between the plurality of roller pairs.

8. An image forming apparatus provided with an image forming unit for forming an image on a sheet conveyed by a sheet conveyance apparatus, the image forming apparatus comprising:

a confluence portion formed by a first sheet conveyance path joining in a second sheet conveyance path;

a first sheet conveyance unit which is provided at an upstream side of the confluence portion and configured to convey a sheet in the first sheet conveyance path; and a second sheet conveyance unit which is provided at a downstream side of the confluence portion and configured to convey a sheet conveyed from the first sheet conveyance path to the second sheet conveyance path, wherein the confluence portion is provided with a conveyance rotating member with which a leading edge of the sheet comes into contact, and is connected to a drive transmission unit configured to transmit drive to the conveyance rotating member, and a one-way clutch is arranged at the drive transmission unit, wherein the conveyance rotating member follows a change in a moving speed of the leading edge of the sheet after collision of the leading edge of the sheet with the conveyance rotating member by the one-way clutch.

9. The image forming apparatus according to claim 8, wherein a driving force of a drive source at the second sheet conveyance unit is transmitted to the conveyance rotating member by the drive transmission unit.

10. The image forming apparatus according to claim 8, wherein the conveyance rotating member is a sponge roller.

11. The image forming apparatus according to claim 8, wherein the second sheet conveyance unit is provided with a driven conveyance roller and a conveyance roller pressed against and contacting the driven conveyance roller, and the drive is transmitted from the conveyance roller to the conveyance rotating member.

12. The image forming apparatus according to claim 8, wherein the second sheet conveyance unit is provided with a driven conveyance roller and a drive roller facing the driven conveyance roller, and the conveyance rotating member is a belt stretched between the drive roller and a driven roller arranged upstream of the drive roller in the conveyance direction.

13. The image forming apparatus according to claim 12, wherein the belt is pressed against and contacts the driven conveyance roller.

14. The image forming apparatus according to claim 8, wherein the second sheet conveyance unit includes a plurality of roller pairs formed of driven conveyance rollers and conveyance rollers pressed against and contacting the driven conveyance rollers, the conveyance rotating member is formed of a belt stretched between a drive roller and a driven roller, and the belt is arranged between the plurality of roller pairs.

15. An image reading apparatus provided with an image reading unit for reading an image on a document conveyed by a sheet conveyance apparatus, the image reading apparatus comprising:

a confluence portion formed by a first sheet conveyance path joining in a second sheet conveyance path;

a first sheet conveyance unit which is provided at an upstream side of the confluence portion and configured to convey a document in the first sheet conveyance path; and a second sheet conveyance unit which is provided at a downstream side of the confluence portion and configured to convey the document conveyed from the first sheet conveyance path to the second sheet conveyance path, wherein the confluence portion is provided with a conveyance rotating member with which a leading edge of the document comes into contact, and is connected to a drive transmission unit configured to transmit drive to the conveyance rotating member, and a one-way clutch is arranged at the drive transmission unit, wherein the conveyance rotating member follows a change in a moving speed of the leading edge of the document after collision of the leading edge of the document with the conveyance rotating member by the one-way clutch.

16. The image reading apparatus according to claim 15, wherein a driving force of a drive source at the second sheet conveyance unit is transmitted to the conveyance rotating member by the drive transmission unit.

17. The image reading apparatus according to claim 15, wherein the conveyance rotating member is a sponge roller.

18. The image reading apparatus according to claim 15, wherein the second sheet conveyance unit is provided with a driven conveyance roller and a conveyance roller pressed against and contacting the driven conveyance roller, and the drive is transmitted from the conveyance roller to the conveyance rotating member.

19. The image reading apparatus according to claim 15, wherein the second sheet conveyance unit is provided with a driven conveyance roller and a drive roller facing the driven conveyance roller, and the conveyance rotating member is a belt stretched between the drive roller and a driven roller arranged upstream of the drive roller in the conveyance direction.

20. The image reading apparatus according to claim 19, wherein the belt is pressed against and contacts the driven conveyance roller.

21. The image reading apparatus according to claim 15, wherein the second sheet conveyance unit includes a plurality of roller pairs formed of driven conveyance rollers and conveyance rollers pressed against and contacting the driven conveyance rollers, the conveyance rotating member is formed of a belt stretched between a drive roller and a driven roller, and the belt is arranged between a plurality of roller pairs.

* * * * *